US009844246B2

(12) United States Patent
Yamagishi

(10) Patent No.: US 9,844,246 B2
(45) Date of Patent: Dec. 19, 2017

(54) SLIDER FOR SLIDE FASTENER

(71) Applicant: YKK Corporation, Tokyo (JP)

(72) Inventor: Kouji Yamagishi, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/501,558

(22) PCT Filed: Aug. 21, 2014

(86) PCT No.: PCT/JP2014/071851
§ 371 (c)(1),
(2) Date: Feb. 3, 2017

(87) PCT Pub. No.: WO2016/027340
PCT Pub. Date: Feb. 25, 2016

(65) Prior Publication Data

US 2017/0224061 A1 Aug. 10, 2017

(51) Int. Cl.
*A44B 19/30* (2006.01)
*A44B 19/26* (2006.01)

(52) U.S. Cl.
CPC ..... *A44B 19/30* (2013.01); *A44B 19/26* (2013.01); *A44B 19/262* (2013.01)

(58) Field of Classification Search
CPC ..... A44B 19/306; A44B 19/26; A44B 19/308; Y10T 24/2566; Y10T 24/2571; Y10T 24/2568; Y10T 24/2577; Y10T 24/2586
See application file for complete search history.

(56) References Cited

U.S. PATENT DOCUMENTS 3,138,852 A 6/1964 Mazura
3,793,684 A * 2/1974 Moertel ..... A44B 19/26 24/421
4,679,281 A * 7/1987 Ishii ..... A44B 19/308 24/419

(Continued)

FOREIGN PATENT DOCUMENTS

JP 105304/1974 9/1974
JP 4307356 B2 5/2009
WO 2013/099017 A1 7/2013

OTHER PUBLICATIONS

International Preliminary Report on Patentability, PCT International Patent Application No. PCT/JP2014/071851, dated Mar. 2, 2017

(Continued)

*Primary Examiner* — Robert Sandy
*Assistant Examiner* — Rowland Do
(74) *Attorney, Agent, or Firm* — Kilpatrick Townsend & Stockton LLP

(57) ABSTRACT

There is provided a slide fastener slider. A front mounting portion and a rear mounting portion are respectively provided with receiving grooves for receiving a lock member. The receiving grooves have right and left side walls. Protrusions are respectively provided on upper end edges of the side walls of the front mounting portion. When the upper end portions of the side walls of the front mounting portion are inclined in a direction of approaching each other, the protrusions approach each other, and the protrusions cover the lock member more largely relative to portions of the side walls other than the protrusions.

4 Claims, 9 Drawing Sheets

(56) References Cited

U.S. PATENT DOCUMENTS

| | | | | | |
|---|---|---|---|---|---|
| 5,729,874 | A * | 3/1998 | Mizuno | A44B 19/308 | 24/429 |
| 5,848,455 | A * | 12/1998 | Ikehara | A44B 19/306 | 24/421 |
| 5,884,373 | A * | 3/1999 | Kawamura | A44B 19/306 | 24/419 |
| 6,314,624 | B1 * | 11/2001 | Lin | A44B 19/308 | 24/421 |
| 6,497,016 | B1 * | 12/2002 | Lin | A44B 19/308 | 24/418 |
| 6,588,072 | B1 * | 7/2003 | Lin | A44B 19/265 | 24/416 |
| 6,591,464 | B2 * | 7/2003 | Lin | A44B 19/308 | 24/419 |
| 7,337,510 | B2 * | 3/2008 | Yamagishi | A44B 19/306 | 24/421 |
| 8,584,326 | B2 * | 11/2013 | Keyaki | A44B 19/306 | 24/420 |
| 8,959,728 | B2 * | 2/2015 | Ozawa | A44B 19/306 | 24/418 |
| 2006/0075611 | A1 | 4/2006 | Yamagishi et al. | | |

OTHER PUBLICATIONS

International Search Report, PCT International Patent Application No. PCT/JP2014/071851, dated Nov. 18, 2014.
Written Opinion, PCT International Patent Application No. PCT/JP2014/071851, dated Nov. 18, 2014.

* cited by examiner

SLIDER FOR SLIDE FASTENER

This application is a national stage application of PCT/JP2014/071851, which is incorporated herein by reference.

TECHNICAL FIELD

The present invention relates to a slider for a slide fastener, and more particularly to a slider for a slide fastener having an automatic stop function.

BACKGROUND ART

As conventional sliders for slide fasteners, a slider is comprised of a slider body, a pull tab and a lock member, which is formed by bending a metal wire material. A front mounting portion and a rear mounting portion, on both of which the lock member is mounted, are erected on the slider body. Each of the front mounting portion and the rear mounting portion has a receiving groove formed to receive the lock member. After the lock member is received in the receiving grooves of the front mounting portion and the rear mounting portion, the lock member is mounted on the front mounting portion and the rear mounting portion by crimping upper end portions of both side walls of the receiving grooves toward the inside of the receiving grooves (e.g., see Patent Document 1).

PRIOR ART DOCUMENT

Patent Document

Patent Document 1: Japanese Patent No. 4307356 B

SUMMARY OF INVENTION

Problems to be Solved by Invention

However, in such a slide fastener slider as described in Patent Document 1, upon assembly of the slider, a member for correcting a position of the lock member is inserted between both side walls of the receiving grooves, and for this purpose a gap is formed between both side walls. Accordingly, if the pull tab is pulled by an excessive force, there is a risk that both side walls are opened and thus the lock member is detached from the front mounting portion and the rear mounting portion of the slider body.

The present invention has been made keeping in mind the above problem, and an object thereof is to provide a slide for a fastener slider, in which a mounting strength of a lock member to a slider body is enhanced so that even if an excessive pulling force is exerted on a pull tab, the lock member can be prevented from being detached from the slider body.

Means for Solving Problems

The above object of the present invention is achieved by the following configurations:

(1) A slide fastener slider comprising a slider body, a pull tab and a lock member, wherein the slider body comprises: a lower blade; a guide post erected on a front end portion of the lower blade; an upper blade extending rearward from the guide post; right and left wall portions erected along both right and left side edges of the lower blade; right and left flanges extending from upper ends of the right and left wall portions in a direction of approaching each other; a front mounting portion erected on the guide post and configured to mount the lock member thereon; and a rear mounting portion erected on the upper blade and configured to mount the lock member thereon, wherein the front mounting portion and the rear mounting portion are respectively provided with receiving grooves for receiving the lock member, wherein the receiving grooves have right and left side walls, wherein protrusions are respectively provided on upper end edges of the right and left side walls of the front mounting portion, wherein upper end portions of the right and left side walls of the front mounting portion and the rear mounting portion are inclined in a direction of approaching each other, so that the lock member is fixed to the front mounting portion and the rear mounting portion, and wherein when the upper end portions of the right and left side walls of the front mounting portion are inclined in the direction of approaching each other, the protrusions of the right and left side walls approach each other, and the protrusions of the right and left side walls cover the lock member more largely relative to portions of the right and left side walls other than the protrusions.

(2) The slide fastener slider according to (1), wherein the protrusions are respectively formed at the most rear location on the upper end edges of the side walls of the front mounting portion.

(3) The slide fastener slider according to (2), wherein rear surfaces of the front mounting portion and rear surfaces of the protrusions are formed as a continuous flat surface.

Advantageous Effects of Invention

According to the slide fastener slider of the present invention, the protrusions are respectively provided on the upper end edge of each of the right and left side walls of the front mounting portion. Therefore, when the upper end portions of the right and left side walls of the front mounting portion are inclined in the direction of approaching each other, the protrusions of the right and left side walls approach each other, and also the protrusions of the right and left side walls cover the lock member more largely relative to portions of the right and left side walls other than the protrusions. Accordingly, an upward movement of the lock member is pressed down by the right and left protrusions, thereby enhancing a mounting strength of the lock member to the slider body. As a result, even if an excessive pulling force is exerted on the pull tab, the lock member can be prevented from being detached from the slider body.

EMBODIMENTS OF INVENTION

Hereinafter, one embodiment of a slide fastener slider according to the present invention will be described in detail on the basis of the accompanying drawings. In the following description, as for the slider, an upper side refers to an upper side with respect to the paper surface of FIG. 3, a lower side refers to a lower side with respect to the paper surface of FIG. 3, a front side refers to a right side with respect to the paper surface of FIG. 3, a rear side refers to a left side with respect to the paper surface of FIG. 3, a right side refers to a near side with respect to the paper surface of FIG. 3, and a left side refers to a far side with respect to of the paper surface of FIG. 3. More specifically, a side from which disengaged fastener elements emerge is referred to as the front side and a side from which engaged fastener elements emerge is referred to as the rear side, and therefore a sliding direction of the slider is referred to as a front and rear direction (length direction), a direction perpendicular to the front and rear direction in a horizontal plane along the front and rear direction is referred to as a right and left direction (width direction), and a direction perpendicular to the front and rear direction and also the right and left direction is referred to as an upward and downward direction.

Figure 1:
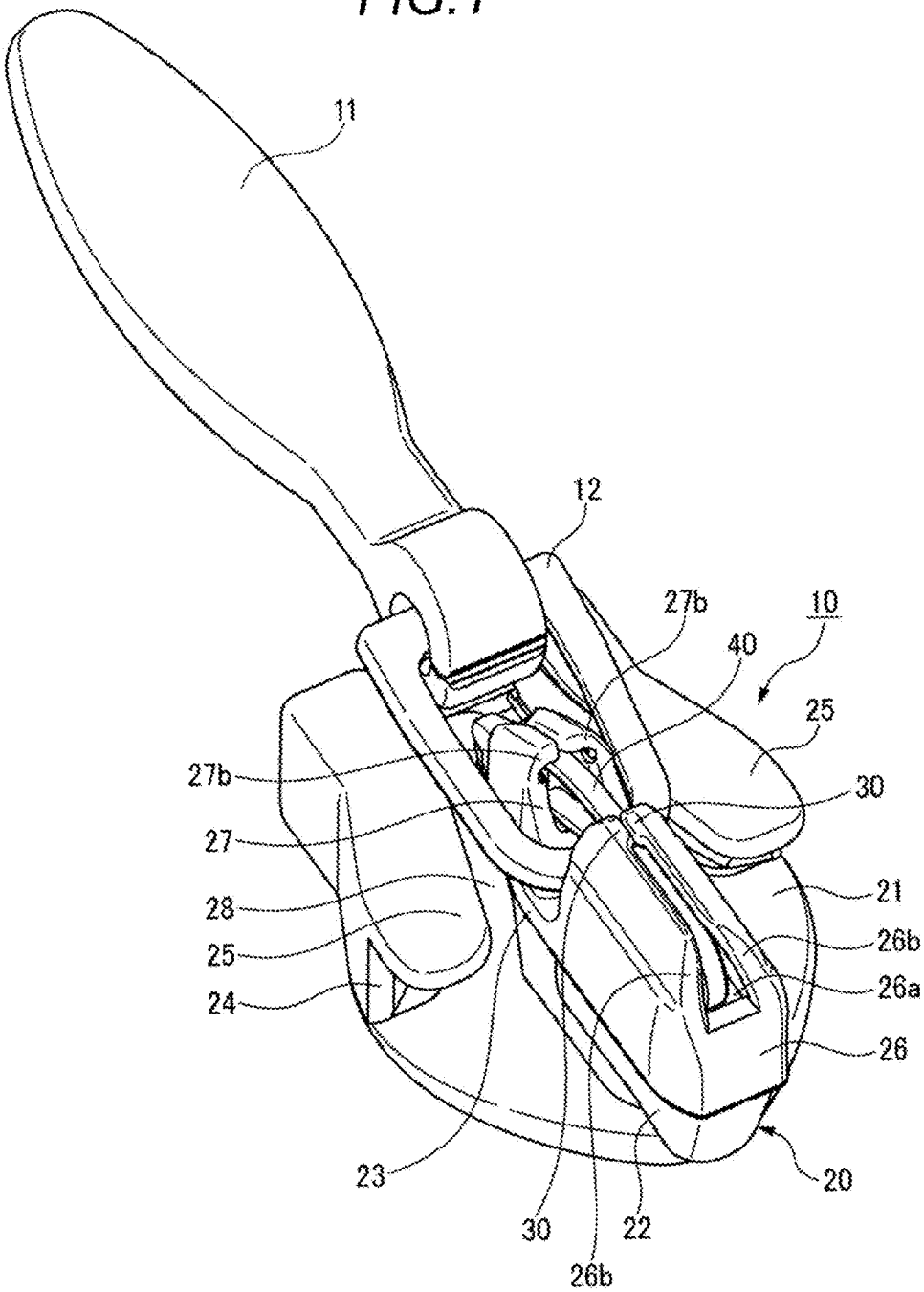
FIG. 1 is a perspective view of one embodiment of a slide fastener slider according to the present invention.
Figure 2:
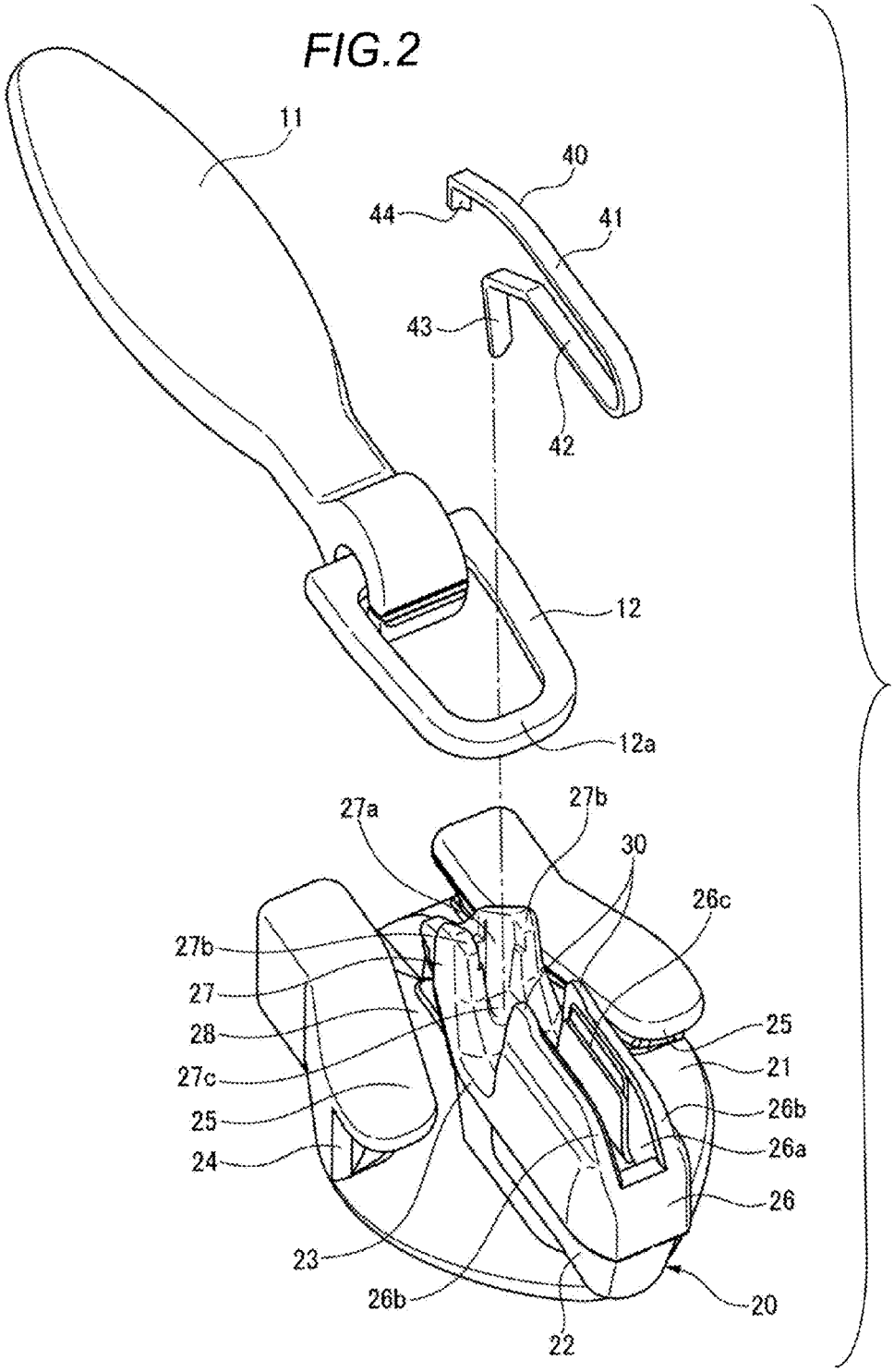
FIG. 2 is an exploded perspective view of the slider shown in FIG. 1.

The slide fastener slider 10 of the present embodiment is a slider having an automatic stop device and configured to be used in concealed slide fasteners, and as shown in FIGS. 1 and 2, is comprised of a slider body 20, a pull tab 11 and a lock member 40. The slide body 20 and the pull tab 11 are formed by die-casting a metal, such as zinc alloy or aluminum alloy.

As shown in FIG. 1, the pull tab 11 is formed by a generally rectangular-shaped gripper 13 having a C-shaped connection ring on a distal end thereof, and is configured so that on such a connection portion, a rectangular ring-shaped damper, i.e., a connection ring 12 is pivotally attached.

As shown in FIGS. 2 to 5, the slider body 20 includes a lower blade 21, a guide post 22 erected on a front end portion of the lower blade 21, an upper blade 23 extending rearward from the guide post 22, right and left wall portions 24 erected along both right and left side edges of the lower blade 21, right and left flanges 25 extending from upper ends of the right and left wall portions 24 in a direction of approaching each other, a front mounting portion 26 erected on the guide post 22 and configured to mount the lock member 40 thereon, and a rear mounting portion 27 erected on the upper blade 23 and configured to mount the lock member 40 thereon. The front mounting portion 26 and the rear mounting portion 27 are arranged to interpose a recess 29 therebetween, and thus the front mounting portion 26 is positioned in front of the recess 29 and the rear mounting portion 27 is positioned in the rear of the recess 29. Also, the lower blade 21, the guide post 22, the upper blade 23, the right and left wall portions 24 and the right and left flanges 25 define an element guide passage 28 having a generally Y shape as viewed in a top view and configured to guide fastener element rows, not shown, therethrough.

Figure 3:
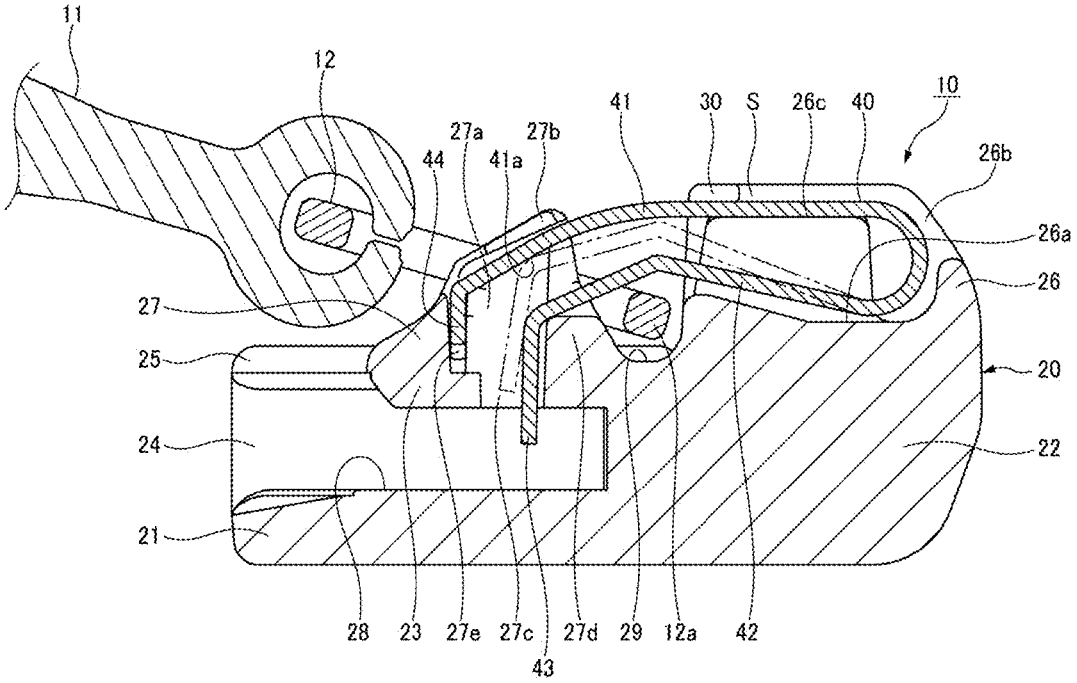
FIG. 3 is a longitudinal sectional view of the slider shown in FIG. 2.
Figure 5:
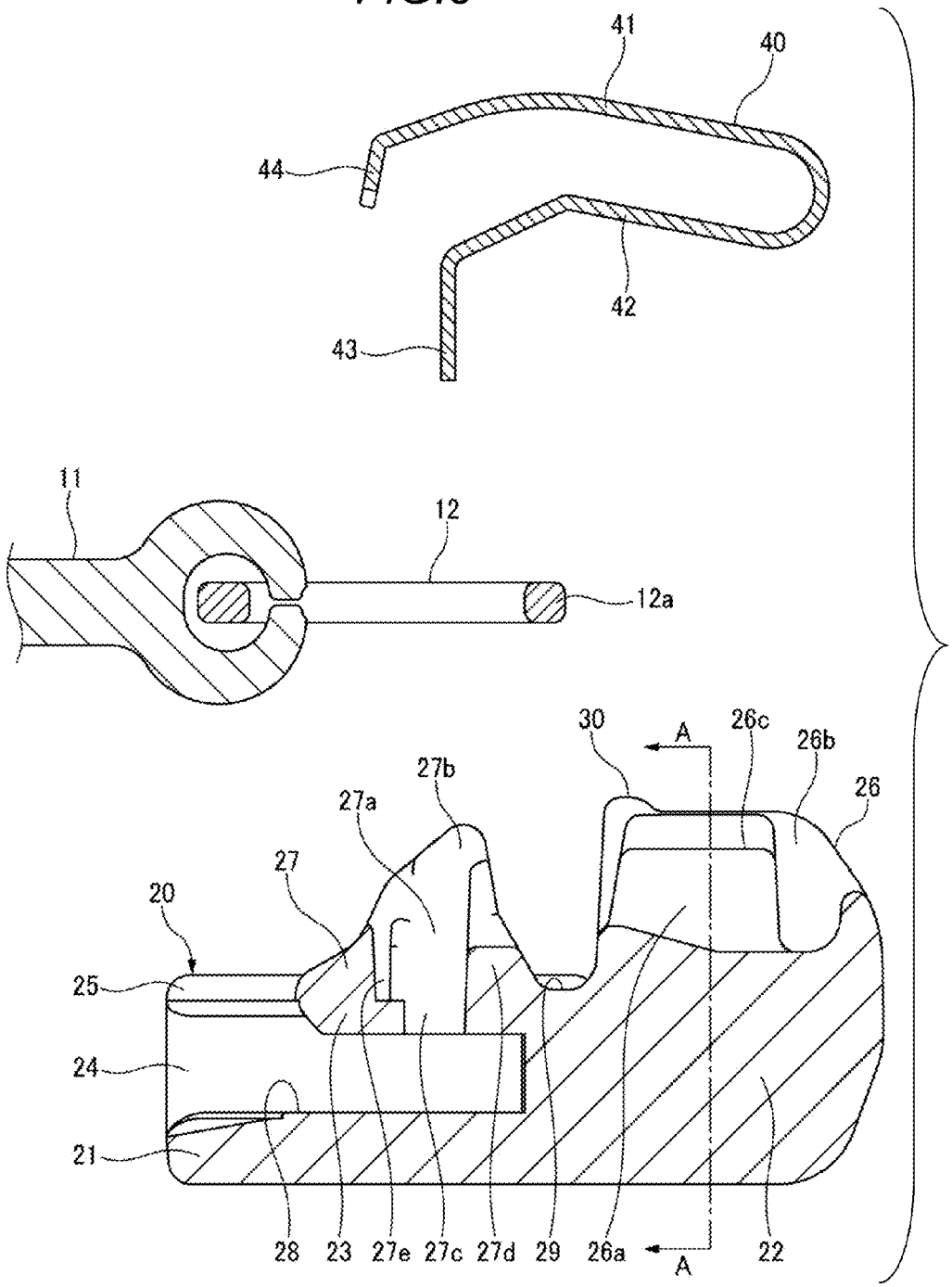
FIG. 5 is an exploded longitudinal sectional view of the slider shown in FIG. 3.

The lock member 40 is formed by cutting a rectangular cross-sectional wire material made of stainless steel or the like at a predetermined length and then bending the cut wire material. As shown in FIGS. 3 and 5, the lock member 40 has an upper piece 41 and a lower piece 42 defined by bending the wire material into a generally U shape, a stop claw 43 extending downward from a rear end portion of the lower piece 42, and an insertion piece 44 extending downward from a rear end portion of the upper piece 41.

Figure 6:
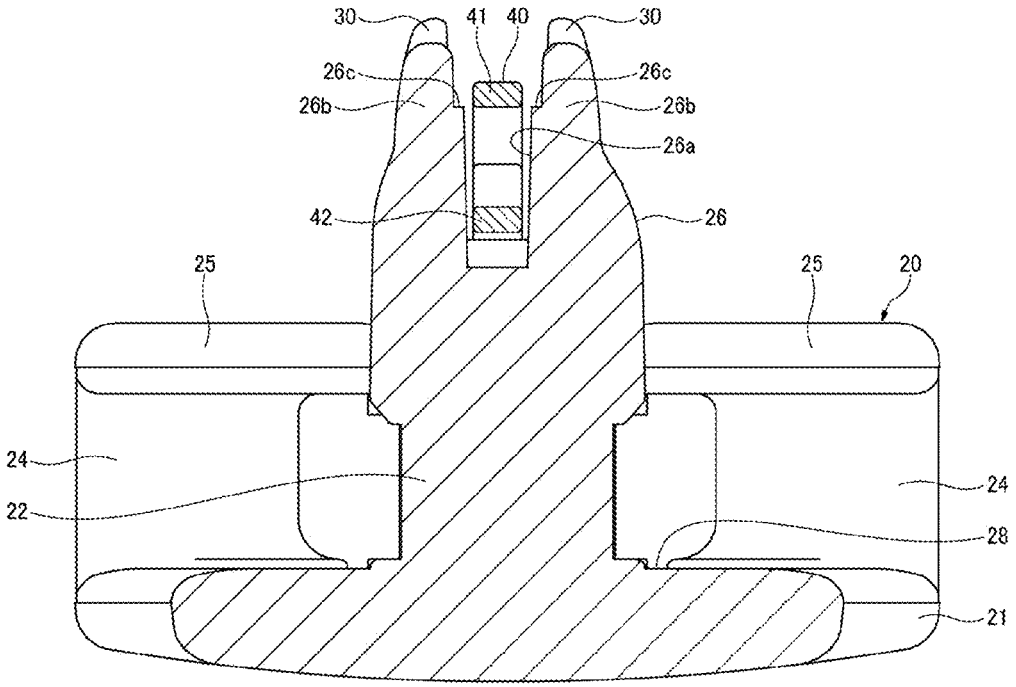
FIG. 6 is a sectional view taken along a line A-A in FIG. 5.
Figure 7:
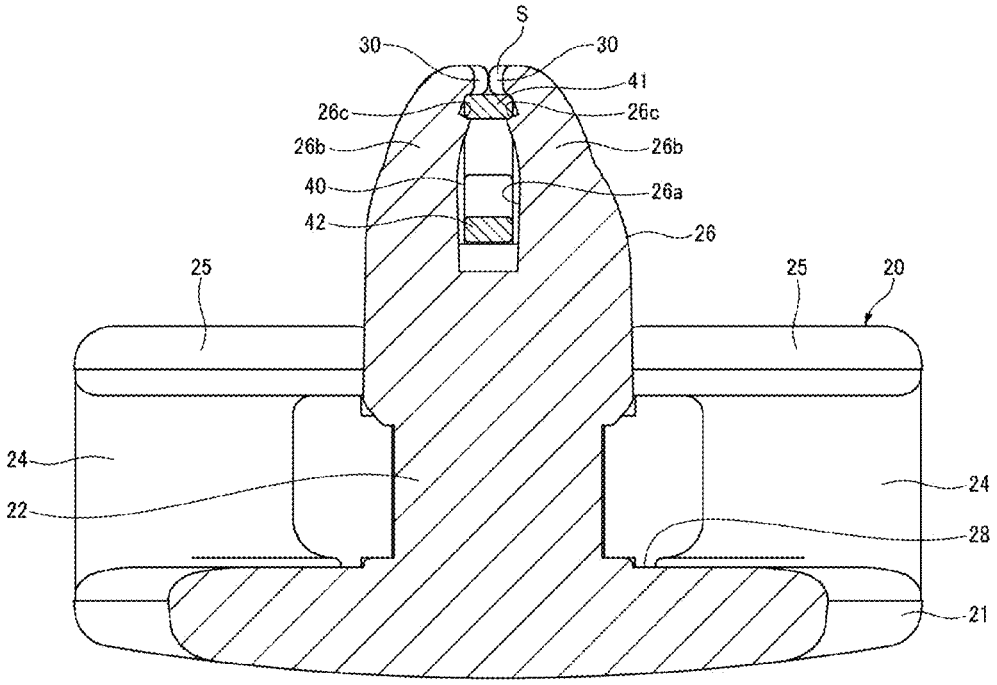
FIG. 7 is a sectional view showing a state where upper end portions of right and left side walls of a receiving groove shown in FIG. 6 are crimped.

As shown in FIGS. 3 and 5, the front mounting portion 26 and the rear mounting portion 27 have, respectively, receiving grooves 26*a*, 27*a* for receiving the lock member 40 and the receiving grooves 26*a*, 27*a* have right and left side walls 26*b*, 27*b*. Also, as shown in FIGS. 6 and 7, the lock member 40 is received in the receiving grooves 26*a*, 27*a* of the front mounting portion 26 and the rear mounting portion 27 and then upper end portions of the right and left side walls 26*b*, 27*b* are crimped in a direction of approaching each other. As a result, the upper piece 41 of the lock member 40 is sandwiched between the right and left side walls 26*b*, 27*b* and thus fixed by the front and rear mounting portions 26, 27.

Also, as shown in FIGS. 3 to 7, each of the right and left side walls 26*b* of the front mounting portion 26 has, on an inner surface thereof, a shelf portion 26*c* formed to protrude toward the inside of the receiving groove 26*a*. Also, when the upper end portions of the right and left side walls 26*b* are crimped, the shelf portions 26*c* enter between the upper piece 41 and the lower piece 42 of the lock member 40 so that the upper piece 41 of the lock member 40 is placed on the shelf portions 26*c*.

Further, as shown in FIGS. 3 and 5, the rear mounting portion 27 has a claw hole 27*c* formed to extend in the upward and downward direction therethrough and thus to allow the stop claw 43 of the lock member 40 to be inserted therein. Also, a protrusion limiting portion 27*d* for limiting an amount of protrusion of the stop claw 43 into the element guide passage 28 is formed by protruding and raising a front wall surface of the claw hole 27*c* upward. In addition, an insertion recess 27*e* configured to allow the insertion piece 44 of the lock member 40 to be inserted and retained therein is formed on a rear side of the claw hole 27*c*. The claw hole 27*c*, the protrusion limiting portion 27*d* and the insertion recess 27*e* all are positioned between the right and left side walls 27*b* of the rear mounting portion 27, the protrusion limiting portion 27*d* is positioned in front of the claw hole 27*c*, and the insertion recess 27*e* is positioned in the rear of the claw hole 27*c*.

Figure 4:
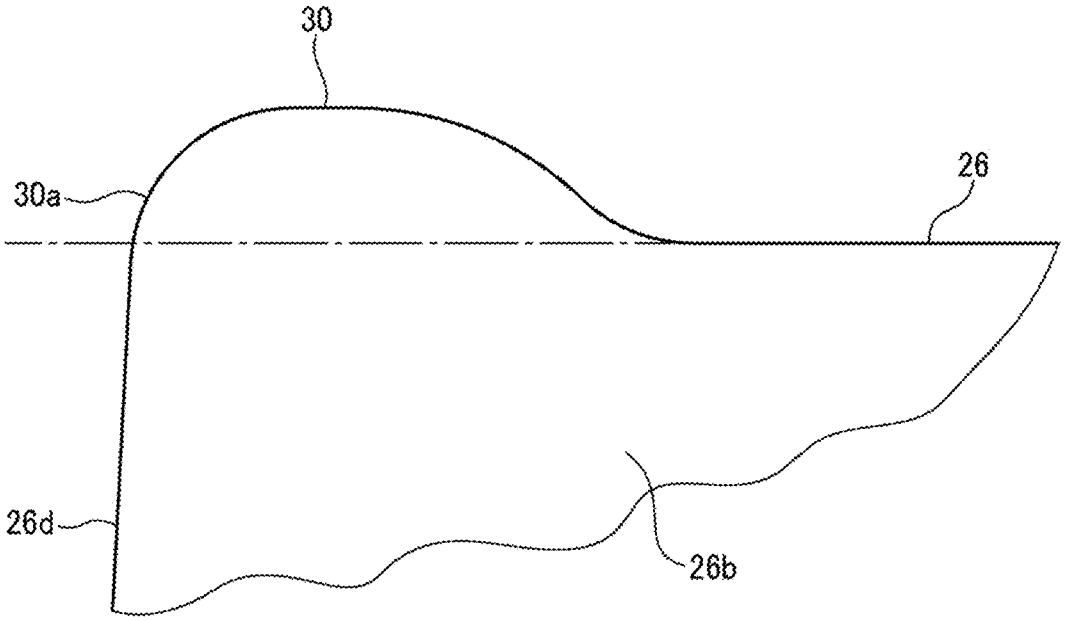
FIG. 4 is an enlarged side view explaining protrusions on side walls of a front mounting portion.
Figure 8:
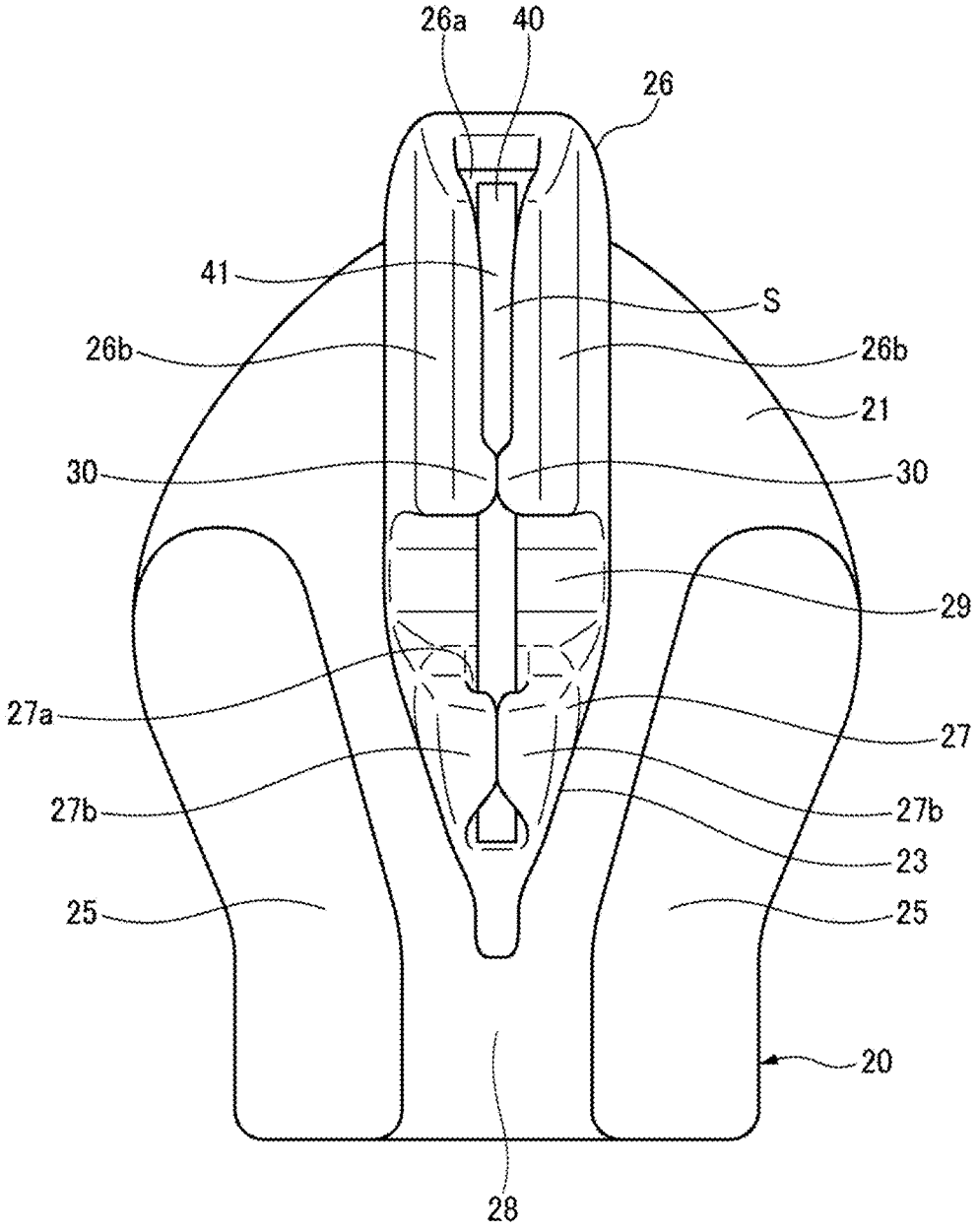
FIG. 8 is a top view showing the slider shown in FIG. 7.

Further, as shown in FIGS. 4 to 6, protrusions 30 are respectively formed on an upper end edge of each of the right and left side walls 26*b* of the front mounting portion 26. Therefore, when the upper end portions of the right and left side walls 26*b* are crimped, the right and left side walls 26*b* are inclined so that the upper end portions approach each other. As a result, the protrusions 30 of the right and left side walls 26*b* approach each other, and also the protrusions 30 of the right and left side walls 26*b* cover the upper piece 41 of the lock member 40 more largely relative to portions of the right and left side walls 26*b* other than the protrusions 30 (see FIGS. 7 and 8). Further, the protrusions 30 are respectively formed at the most rear location on the upper end edge of each of the side walls 26*b* of the front mounting portion 26, and rear surfaces 26*d* of the side walls 26*b* and rear surfaces 30*a* of the protrusions 30 are formed as a continuous flat surface.

Next, procedures of assembling the slide fastener slider 10 will be described. First, a pivot 12*a* of the connection ring 12 of the pull tab 11 is arranged in the recess 29 between the front mounting portion 26 and the rear mounting portion 27 of the slider body 20. Subsequently, the lock member 40 is received in the receiving grooves 26*a*, 27*a* of the front mounting portion 26 and the rear mounting portion 27, and at the same time the lock member 40 is placed on the pivot 12*a* of the connection ring 12. At this time, the stop claw 43 of the lock member 40 is inserted into the claw hole 27*c* of the rear mounting portion 27, and also the insertion piece 44 of the lock member 40 is inserted into the insertion recess 27*e* of the rear mounting portion 27. Subsequently, the upper end portions of the right and left side walls 26*b*, 27*b* of the front mounting portion 26 and the rear mounting portion 27 are crimped in the direction of approaching each other, so that the lock member 40 is fixed to the front mounting portion 26 and the rear mounting portion 27. Meanwhile, after crimping, a gap S (see FIGS. 7 and 8) is formed between the right and left side walls 26*b* of the front mounting portion 26. The gap S is a gap through which a member for correcting a position of the lock member 40 is to be inserted upon assembly of the slider.

In the slide fastener slider 10 configured as described above, as the pull tab 11 is pulled, the lower piece 42 of the lock member 40 is lifted (see a two-dot chain line in FIG. 3) and thus an upper surface of the lower piece 42 comes in contact with a lower surface of the upper piece 41 of the lock member 40, thereby limiting an upward movement of the stop claw 43. Therefore, the lower surface of the upper piece 41 defines an upward movement limiting portion 41*a* for limiting an upward movement position of the stop claw 43. Subsequently, if the pull tab 11 is released, the lower piece 42 is moved downward due to an urging force of the lock member 40 and thus the lower piece 42 comes in contact with the protrusion limiting portion 27*d*. Accordingly, an amount of protrusion of the stop claw 43 into the element guide passage 28 is limited (adjusted), and as a result, the stop claw 43 does not protrude into the element guide passage 28 more than necessary.

As described above, according to the slide fastener slider 10 of the present embodiment, the protrusions 30 are respectively provided on the upper end edge of each of the right and left side walls 26*b* of the front mounting portion 26. Therefore, when the upper end portions of the right and left side walls 26*b* of the front mounting portion 26 are inclined in the direction of approaching each other, the protrusions 30 of the right and left side walls 26*b* approach each other, and also the protrusions 30 of the right and left side walls 26*b* are configured to cover the upper piece 41 of the lock member 40 more largely relative to portions of the right and left side walls 26*b* other than the protrusions 30. Accordingly, an upward movement of the lock member 40 is pressed down by the right and left protrusions 30, thereby enhancing a mounting strength of the lock member 40 to the slider body 20. As a result, even if an excessive pulling force is exerted on the pull tab 11, the lock member 40 can be prevented from being detached from the slider body 20.

Also, according to the slide fastener slider 10 of the present embodiment, the protrusions 30 are respectively formed at the most rear location on the upper end edge of each of the side walls 26*b* of the front mounting portion 26. Accordingly, an upward movement of the lock member 40 can be more effectively pressed down by the right and left protrusions 30, thereby further enhancing the mounting strength of the lock member 40 to the slider body 20. Meanwhile, the reason that the lock member 40 is more effectively pressed down is that a portion of the lock member 40, which is to be pressed down by the protrusions 30, is a portion, from which the lock member would otherwise first start to fall out of a groove therebetween when the pull tab 11 is pulled by an excessive force.

Figure 9:
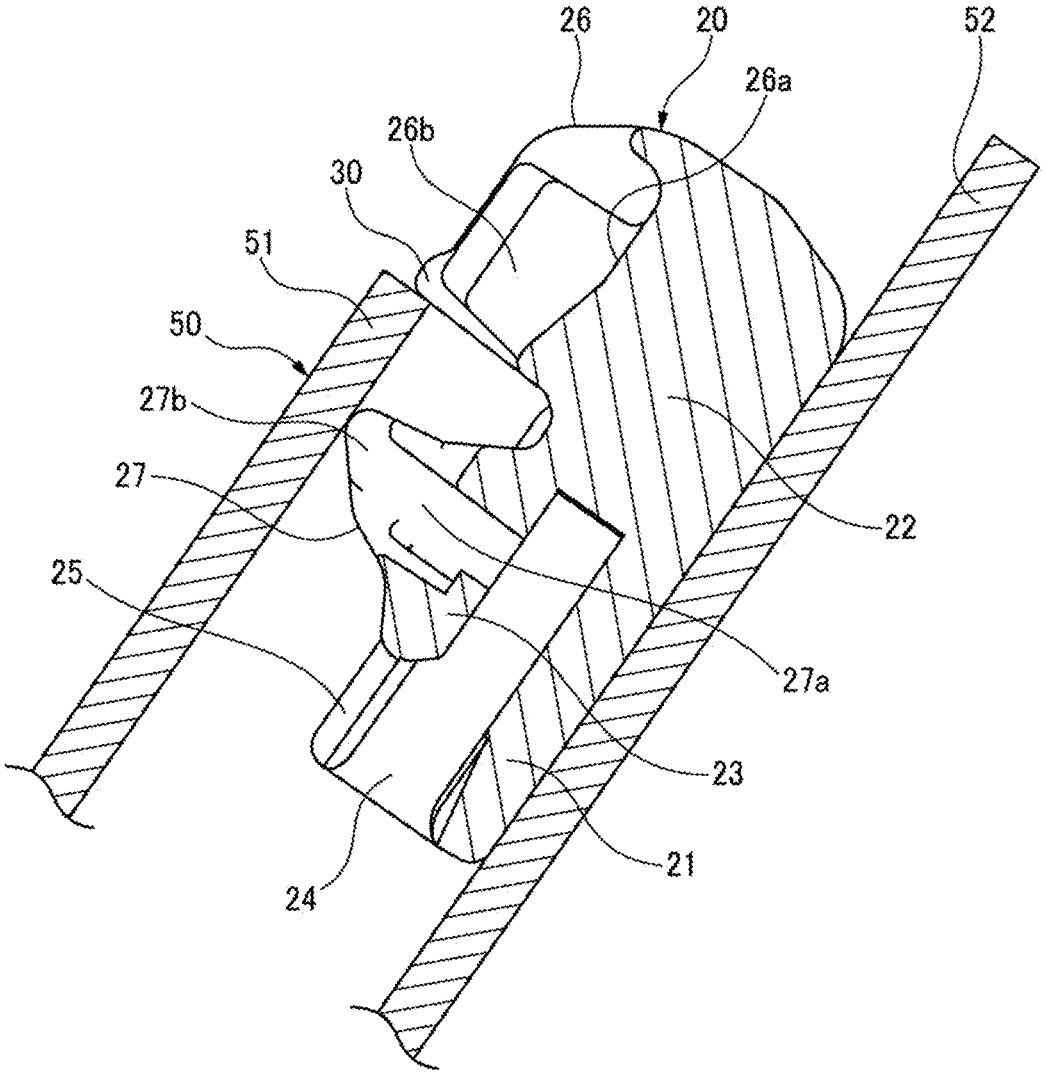
FIG. 9 is a sectional view of a main part explaining a state where a slider body shown in FIG. 2 is being conveyed by a parts feeder.

Also, as shown in FIG. 9, the protrusions 30 formed on the right and left side walls 26*b* of the front mounting portion 26 are also used when the slider body 20 is conveyed by a vibratory parts feeder 50 upon assembly of the slider. Specifically, a guide plate 51 of the parts feeder 50 for guiding the rear surfaces 26*d* of the side walls 26*b* of the front mounting surface 26 is also used for guiding the rear surfaces 30*a* of the protrusions 30. In a case of a slider body of a type, in which no protrusion 30 is provided, a contact area between the guide plate 51 and rear surfaces 26*d* of side walls 26*b* is small. Therefore, the side walls 26*b* are likely to deviate from the guide plate 51, and thus there is a risk that the slider body is sandwiched between guide plates 51, 52, thereby stopping conveyance thereof. Namely, since the guide plate 51 guides the rear surfaces 30*a* of the protrusions 30 as well as the rear surfaces 26*d* of the side walls 26*b*, the side walls 26*b* do not deviate from the guide plate 51, thereby stabilizing conveyance of the slider body by the parts feeder 50. Meanwhile, the guide plate 52 is intended to guide a lower surface of the lower blade 21 of the slider body 20.

Meanwhile, the present invention is not limited to configurations as illustrated in each of the foregoing embodiments, and accordingly, appropriate modifications thereof may be made without departing from the spirit and scope of the invention.

DESCRIPTION OF REFERENCE NUMERALS

10 Slide Fastener Slider
11 Pull Tab
20 Slider Body
21 Lower Blade
22 Guide Post
23 Upper Blade
24 Wall Portion
25 Flange
26 Front Mounting Portion
26*a* Receiving Groove
26*b* Side Wall
26*d* Rear Surface
27 Rear Mounting Portion
27*a* Receiving Groove
27*b* Side Wall
30 Protrusion
30*a* Rear Surface
40 Lock Member

The invention claimed is:

1. A slide fastener slider comprising a slider body, a pull tab and a lock member, wherein the slider body comprises:

a lower blade;

a guide post erected on a front end portion of the lower blade;

an upper blade extending rearward from the guide post;

right and left wall portions erected along both right and left side edges of the lower blade;

right and left flanges extending inwardly from upper ends of the right and left wall portions so as to approach each other;

a front mounting portion erected on the guide post and configured to mount the lock member thereon; and a rear mounting portion erected on the upper blade and configured to mount the lock member thereon, wherein the front mounting portion and the rear mounting portion are respectively provided with receiving grooves for receiving the lock member, wherein the receiving grooves have right and left side walls, wherein a part of an upper end edge of the right side wall of the front mounting portion is flat and another part of the upper end edge of the right side wall of the front mounting portion has a first protrusion which protrudes beyond the flat part of the upper end edge of the right side wall, wherein a part of an upper end edge of the left side wall of the front mounting portion is flat and another part of the upper end edge of the left side wall of the front mounting portion has a second protrusion which protrudes beyond the flat part of the upper end edge of the left side wall, wherein upper end portions of the right and left side walls of the front mounting portion and the rear mounting portion are inclined inwardly so as to approach each other, so that the lock member is fixed to the front mounting portion and the rear mounting portion, and wherein when the upper end portions of the right and left side walls of the front mounting portion are inclined inwardly so as to approach each other, the first and second protrusions of the right and left side walls approach each other, and the first and second protrusions of the right and left side walls cover the lock member more largely relative to the flat parts of the upper end edge of the right and left side walls.

2. The slide fastener slider according to claim 1, wherein the first protrusion is formed at a most rear location on the upper end edge of the right side wall of the front mounting portion and the second protrusion is formed at a most rear location on the upper end edge of the left side wall of the front mounting portion.

3. The slide fastener slider according to claim 2, wherein rear surfaces of the front mounting portion and rear surfaces of the first and second protrusions are respectively formed as continuous flat surfaces.

4. The slide fastener slider according to claim 1, wherein when the upper end portions of the right and left side walls of the front mounting portion are inclined inwardly so as to approach each other, the first and second protrusions come in contact with each other and the flat parts of the upper end edge of the right and left side walls are separated from each other.

* * * * *